US007331535B2

(12) United States Patent
Lambert et al.

(10) Patent No.: US 7,331,535 B2
(45) Date of Patent: Feb. 19, 2008

(54) INJECTION NOZZLE

(75) Inventors: Malcolm David Dick Lambert, Bromley (GB); Modhu Nandy, Harrow (GB); Alan Conway Green, Maidstone (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/636,112

(22) Filed: Aug. 7, 2003

(65) Prior Publication Data

US 2004/0026532 A1 Feb. 12, 2004

Related U.S. Application Data

(63) Continuation of application No. 09/654,458, filed on Sep. 1, 2000, now abandoned.

(30) Foreign Application Priority Data

Sep. 3, 1999 (GB) ..... 9920687.2
Oct. 10, 1999 (GB) ..... 9924460.0

(51) Int. Cl.
*B05B 1/24* (2006.01)

(52) U.S. Cl. ..... 239/132; 239/533.3

(58) Field of Classification Search ..... 239/128, 239/132, 553.2–533.12; 165/133
See application file for complete search history.

(56) References Cited

U.S. PATENT DOCUMENTS 4,296,887 A * 10/1981 Hofmann ..... 239/397.5
5,987,882 A * 11/1999 Voss et al. ..... 123/670
6,105,884 A 8/2000 Molnar et al.
6,108,189 A * 8/2000 Weldon et al. ..... 279/128
6,172,331 B1 * 1/2001 Chen ..... 219/121.7
6,179,220 B1 1/2001 Kolkman et al.
6,189,817 B1 2/2001 Lambert
6,260,537 B1 7/2001 Lamb et al.
6,267,307 B1 * 7/2001 Pontoppidan ..... 239/104
6,378,503 B1 4/2002 Lambert
6,422,199 B1 7/2002 Buckley et al.
6,520,154 B2 2/2003 Lamb et al.
6,528,189 B1 * 3/2003 Beele ..... 428/698

FOREIGN PATENT DOCUMENTS

DE 3623221 A 2/1988
DE 100 02 366 8/2001

(Continued)

OTHER PUBLICATIONS

Roode Van M. Et al. "Ceramic Coating for corrosionEnvironments" Cermaic Engineering and Science Proceedings, Columbus, US vol. 9., No. 9/10- Sep. 1, 1988 pp. 1245-1259.
XP 000036419, Sep. 1, 1988.

*Primary Examiner*—Christopher Kim
(74) *Attorney, Agent, or Firm*—David P. Wood

(57) ABSTRACT

An injection nozzle for use in delivering fuel to a combustion space, the injection nozzle comprising a nozzle body, at least a part of which is provided with a first coating arranged so as to reduce the temperature of at least a part of the nozzle body, in use. The coating may have either a higher or lower thermal conductivity than the thermal conductivity of the nozzle body.

7 Claims, 5 Drawing Sheets

FOREIGN PATENT DOCUMENTS

| | | | |
|---|---|---|---|
| EP | 0151793 | A | 8/1985 |
| EP | 0828075 | A | 3/1998 |
| JP | 020672 | A | 1/1987 |
| JP | 10274134 | A | 10/1998 |
| WO | WO 99/31382 | | 9/1998 |
| WO | WO99/31382 | * | 6/1999 |

* cited by examiner

INJECTION NOZZLE

This application is a continuation of U.S. application Ser. No. 09/654,458, filed Sep. 1, 2000 now abandoned.

TECHNICAL FIELD

This invention relates to an injection nozzle suitable for use in a fuel injector for use in the delivery of fuel under high pressure to a combustion space of a compression ignition internal combustion engine.

BACKGROUND OF THE INVENTION

An injection nozzle is exposed, in use, to the temperature within the engine cylinder or other combustion space. As a result, the parts of the injection nozzle which are exposed to such temperatures, for example the seating surface, must be able to withstand such temperatures without significant degradation which would otherwise result in an undesirable reduction in the service life of the injection nozzle. Further, the deposition of fuel lacquer within the injection nozzle, which can undesirably effect, for example, the fuel flow rate through the injector, is accelerated where the nozzle is exposed to high operating temperatures.

In a known arrangement, in order to protect an injection nozzle from degradation resulting from the temperature within the cylinder or combustion space, a heat shield in the form of a tubular member is provided, the heat shield surrounding a part of the injection nozzle, shielding that part of the nozzle from combustion flames, in use, and conducting heat away from the injection nozzle. Although such an arrangement may result in the service life of the injection nozzle being increased, the provision of the additional heat shield results in the arrangement being relatively complex. Further, in some arrangements, insufficient space may be available to permit the use of such a heat shield.

SUMMARY OF THE INVENTION

It is an object of the invention to provide an injection nozzle in which the disadvantageous effects described hereinbefore are reduced. According to a first aspect of the present invention there is provided an injection nozzle comprising a nozzle body, at least a part of which is provided with a first coating arranged to reduce the temperature of at least a part of the nozzle body, in use.

The provision of such a coating reduces the temperature to which at least the coated part of the injection nozzle is exposed, and thus reduces the risk of degradation and of the deposition of fuel lacquer, and increases the service life of the injection nozzle.

The first coating is conveniently provided over at least the part of the exterior of the nozzle body which is exposed to the temperature within the cylinder or other combustion space, in use.

Typically, the first coating has a thickness of up to 1 mm. Conveniently, the nozzle body is received within an engine cylinder head, in use. The injection nozzle may be provided with one or more outlet opening, the or each outlet opening conveniently being provided in a tip region of the nozzle body which projects from the cylinder head into the engine cylinder or other combustion space.

In one embodiment of the invention, the first coating may take the form of a thermally insulating coating, the first coating having a thermal conductivity lower than the thermal conductivity of the nozzle body. Conveniently, the thermally insulating coating may be a ceramic material. In one embodiment of the invention, the injection nozzle may comprise a further coating formed from a material having a higher thermal conductivity than the thermal conductivity of the nozzle body, wherein the further coating is applied to the first coating to provide a multi-layer coating.

Alternatively, in a preferred embodiment of the invention, the first coating may be formed from a material having a higher thermal conductivity than the thermal conductivity of the nozzle body.

The provision of a coating having a higher thermal conductivity than the thermal conductivity of the nozzle body increases the rate of heat transfer from the nozzle body to the cylinder head within which the nozzle body is received. Thus, heat is transferred away from the one or more outlet openings provided in the nozzle body at a higher rate compared with arrangements in which the nozzle body is uncoated or in which the nozzle body is coated with a material having a lower thermal conductivity than the nozzle body.

Conveniently, the nozzle body may be formed from steel. The first coating is preferably formed from any one of aluminium nitride, aluminium, copper, silver or gold.

At least a part of the tip region of the nozzle body may be uncoated. This has the effect of further improving the heat transfer away from the or each outlet opening.

At least a part of the tip region may be coated with a second coating formed from a material having a lower thermal conductivity than the thermal conductivity of the nozzle body. This has the effect of reducing heat transfer to the tip region, whilst the coating of higher thermal conductivity increases heat transfer away from the tip region. Thus, the or each outlet opening reaches a lower operating temperature for given operating conditions.

Conveniently, the second coating may be formed from a ceramic material. Typically, the second coating has a thickness of up to 1 mm.

In one embodiment of the invention, in which the first coating has a thermal conductivity higher than that of the nozzle body, the injection nozzle may further comprise an additional coating formed from a material having a lower thermal conductivity than the thermal conductivity of the nozzle body, wherein the additional coating is applied to the first coating to provide a multi-layer coating. Preferably, the additional coating is only applied to a part of the first coating which is exposed to the temperature within the combustion space, in use.

Preferably, the first or second coatings may be bonded to the nozzle body by means of an additional subtrate material According to a second aspect of the present invention, there is provided a method of assembling an injection nozzle as herein described, the method comprising the steps of;

initially providing a coating on the nozzle body of the injection nozzle, and subsequently forming one or more outlet opening in the nozzle body by drilling through the coating and the nozzle body.

According to a further aspect of the present invention, there is provided a method of assembling an injection nozzle as herein described, the method comprising the steps of;

forming one or more outlet opening in the nozzle body of the injection nozzle;

providing shielding means in a region of the nozzle body of the injection nozzle in which the or each outlet opening is formed; and subsequently providing a coating on the nozzle body.

BRIEF DESCRIPTION OF THE DRAWINGS

The invention will further be described, by way of example, with reference to the accompanying drawings in which.

DESCRIPTION OF THE PREFERRED EMBODIMENT

Figure 1:
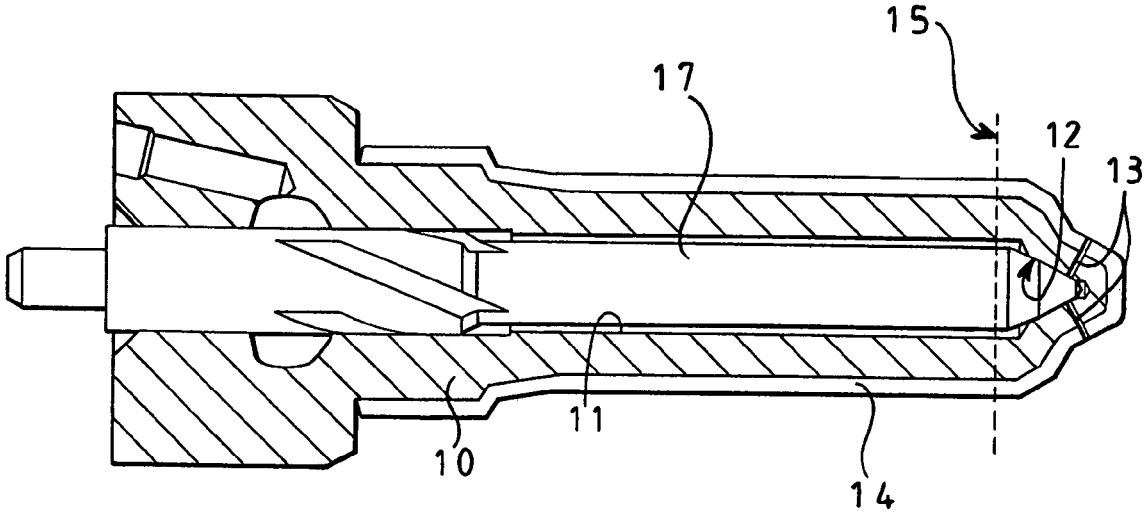
FIG. 1 is a diagrammatic sectional view of an injection nozzle in accordance with an embodiment of the invention.

The injection nozzle illustrated in the accompanying drawings comprises a nozzle body 10 having a blind bore 11 formed therein, the blind bore 11 being supplied with fuel under pressure from a suitable source, for example the common rail of a common rail fuel system. The blind bore 11 is shaped to define, adjacent the blind end thereof, a seating surface 12. In use, a valve needle 17 is slidable within the bore 11. The valve needle 17 is shaped for engagement with the seating surface 12 to control communication between a delivery chamber defined between the bore 11 and the valve needle 17 upstream of the line of engagement between the valve needle 17 and the seating surface 12, and at least one outlet opening 13 which communicates with the bore 11 downstream of the seating surface 12. It will be appreciated that when the valve needle 17 engages the seating surface 12, then fuel is unable to flow from the delivery chamber to the outlet opening(s) 13, thus fuel injection does not take place. Upon movement of the valve needle 17 away from the seating surface 12, fuel is able to flow from the delivery chamber past the seating surface to the outlet opening(s) 13 and injection of fuel takes place. The position occupied by the valve needle 17 is controlled by any suitable technique, for example by controlling the fuel pressure within a control chamber defined, in part, by a surface associated with the valve needle, to control the magnitude of a force applied to the valve needle urging the valve needle towards its seating.

Although the description hereinbefore is of a fuel injector intended for use in a common rail type fuel system, it will be appreciated that the invention is not restricted to injectors of this type, and that the invention is applicable to all types of fuel injector, no matter how they are controlled.

As illustrated in FIG. 1, the exterior of the nozzle body 10 is provided with a coating 14 of a ceramic material, the coating 14 being heat resistant and being relatively thermally insulating. Although in FIG. 1, the ceramic coating 14 is applied over a large part of the exterior of the nozzle body 10, this need not be the case, and the coating 14 could, if desired, be applied only to the part of the nozzle body 10 to the right of the broken line 15, this being the part of the nozzle body 10 which, in use, projects into the cylinder or other combustion space of an engine, and being the part containing the seating surface 12, and so being the part of the nozzle body where there is the greatest risk of degradation, and also the region where the deposition of fuel lacquer is most problematic. It is thought that in order to achieve the desired level of thermal protection for the injection nozzle, it may be desirable to provide a coating of thickness up to 1 mm, although it will be appreciated that the invention is not limited to this particular thickness of material, and that the thickness of the coating will, in practise, be dependent, to some extent, upon the thermal properties of the coating material and the ability of the material of the nozzle body to withstand degradation resulting from exposure to high temperatures. It will be appreciated that alternative materials having similar heat-shielding properties to a ceramic material may be used for the coating 14.

As it is thought that the formation of a ceramic coating of thickness up to 1 mm including openings which align with the outlet openings 13 may be difficult to achieve, it is envisaged to provide the coating on the nozzle body 10 before the outlet opening(s) 13 are drilled, and that the outlet opening(s) 13 may be drilled through the ceramic material coating and the nozzle body 10 in the same operation. Alternatively, the nozzle body 10 may be shielded in the regions of the outlet opening(s) during the coating process to prevent outlet openings being coated. The coating may additionally or alternatively, if desired, be provided in suitable places on the nozzle body 10, prior to heat treatment of the nozzle body 10, thereby sheilding the nozzle body 10 and thus avoiding the formation of a carbon rich layer in places where it is not desired.

Figure 2:
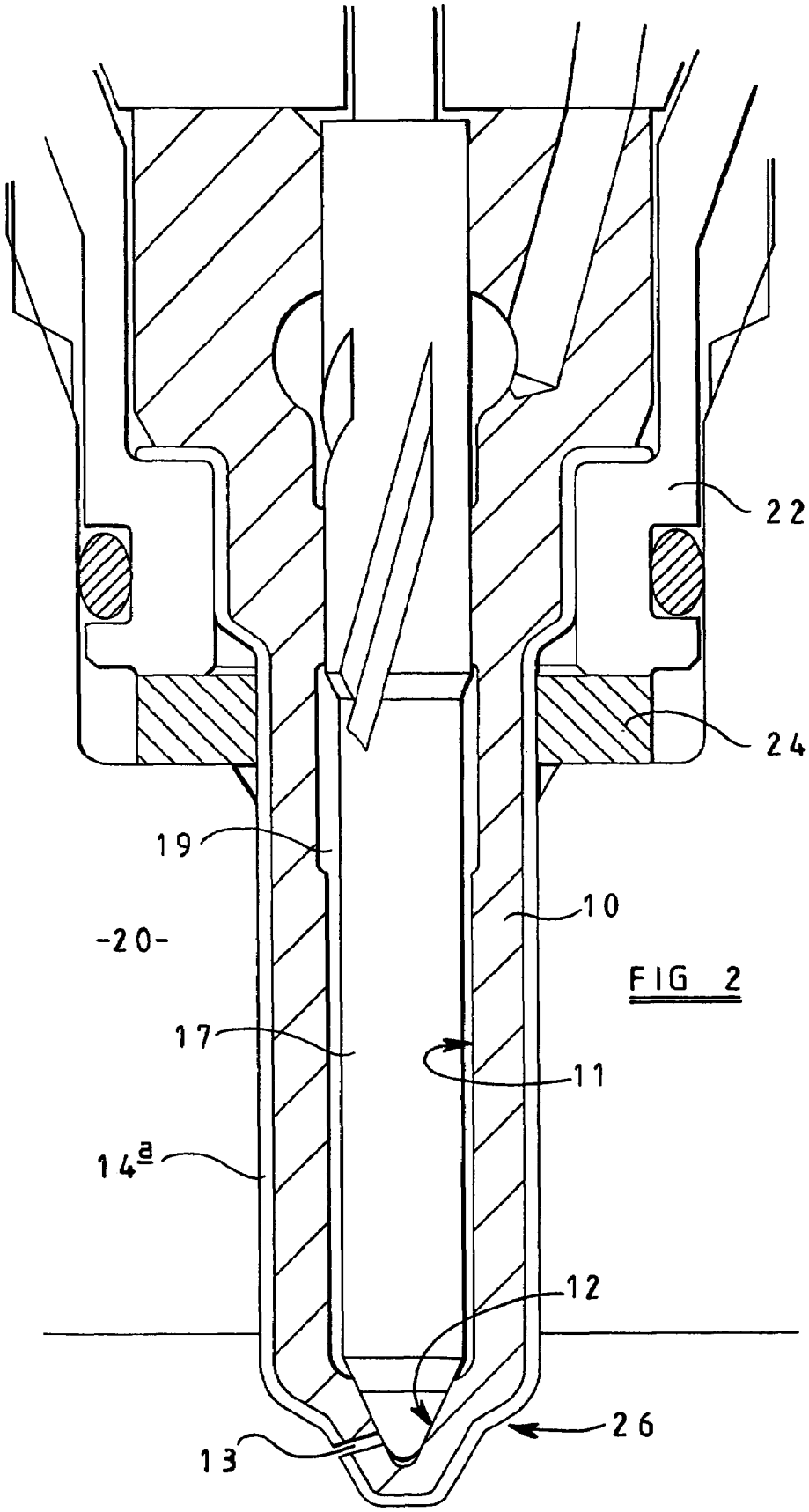
FIGS. 2 and 3 are diagrammatic sectional views of alternative embodiments of the present invention.

FIG. 2 shows a fuel injector in accordance with a further alternative embodiment of the invention in which similar parts to those shown in FIG. 1 are denoted with like reference numerals. In the embodiment shown in FIG. 2, the nozzle body 10 is arranged within an engine cylinder head 20 in a conventional manner, the nozzle body 10 being received within a cap nut 22 which is received within a further bore provided in the cylinder head 20. The nozzle body 10 is provided with an annular sealing member 24 which is arranged to provide a seal between the associated engine cylinder into which fuel is delivered and the upper parts of the injection nozzle and the cylinder head 20. A part of the length of the nozzle body 10 is received within the further bore provided by the cylinder head 20, the nozzle body being provided with a tip region 26 which projects through the open end of the further bore into the associated engine cylinder or other combustion space. The tip region 26 of the nozzle body 10 is that part of the nozzle body 10 which contains the seating surface 12 and the outlet openings 13, and is therefore that part of the nozzle body 10 where there is the greatest risk of degradation and the region where the deposition of fuel lacquer is most problematic.

In the embodiment shown in FIG. 2, the exterior of the nozzle body 10 is provided with the coating **14*a* formed from a material which has a higher thermal conductivity than the material from which the nozzle body 10 is formed, rather than being formed from a material having a lower thermal conductivity. Usually, the nozzle body 10 is formed from a steel alloy having a thermal conductivity in the region of 50 W/mK. Thus, suitable materials from which the coating 14*a* may be formed include aluminium nitride (having a thermal conductivity of 200 W/mK), aluminium (having a thermal conductivity of 204 W/mK), copper (having a thermal conductivity of 384 W/mK), silver (having a thermal conductivity of 407 W/mK) or gold (having a thermal conductivity of 310 W/mK). It will be appreciated, however, that alternative materials having similar thermal properties to the aforementioned materials may also be used for the coating 14*a***.

As the coating **14*a* applied to the nozzle body 10 has a higher thermal conductivity than the nozzle body itself, the rate of heat transfer to the nozzle body 10 will be slightly higher than for the case where no coating is applied or where a coating 14 of lower thermal conductivity than that of the nozzle body 10 is applied, as described previously. In the embodiment shown in FIG. 2, heat is transferred from the tip region 26, including the region in which the outlet openings 13 are formed, to the cylinder head 20 and the sealing member 24 at a higher rate. The net effect of providing the coating 14***a* of relatively higher thermal conductivity is therefore to increase the rate of hear transfer away from the region of the nozzle body 10 where the deposition of fuel lacquer is most problematic. Thus, the operating temperature of that part of the tip region 26 containing the outlet openings 13 is reduced.

As shown in FIG. 2, the coating 14*a* is applied to the part of the nozzle body 10 which projects from the cap nut 22, and an enlarged diameter region of the nozzle body 10 which is received within the cap nut 22. By applying the coating to the enlarged diameter region of the nozzle body, heat is conducted more effectively to the cap nut 22.

Figure 3:
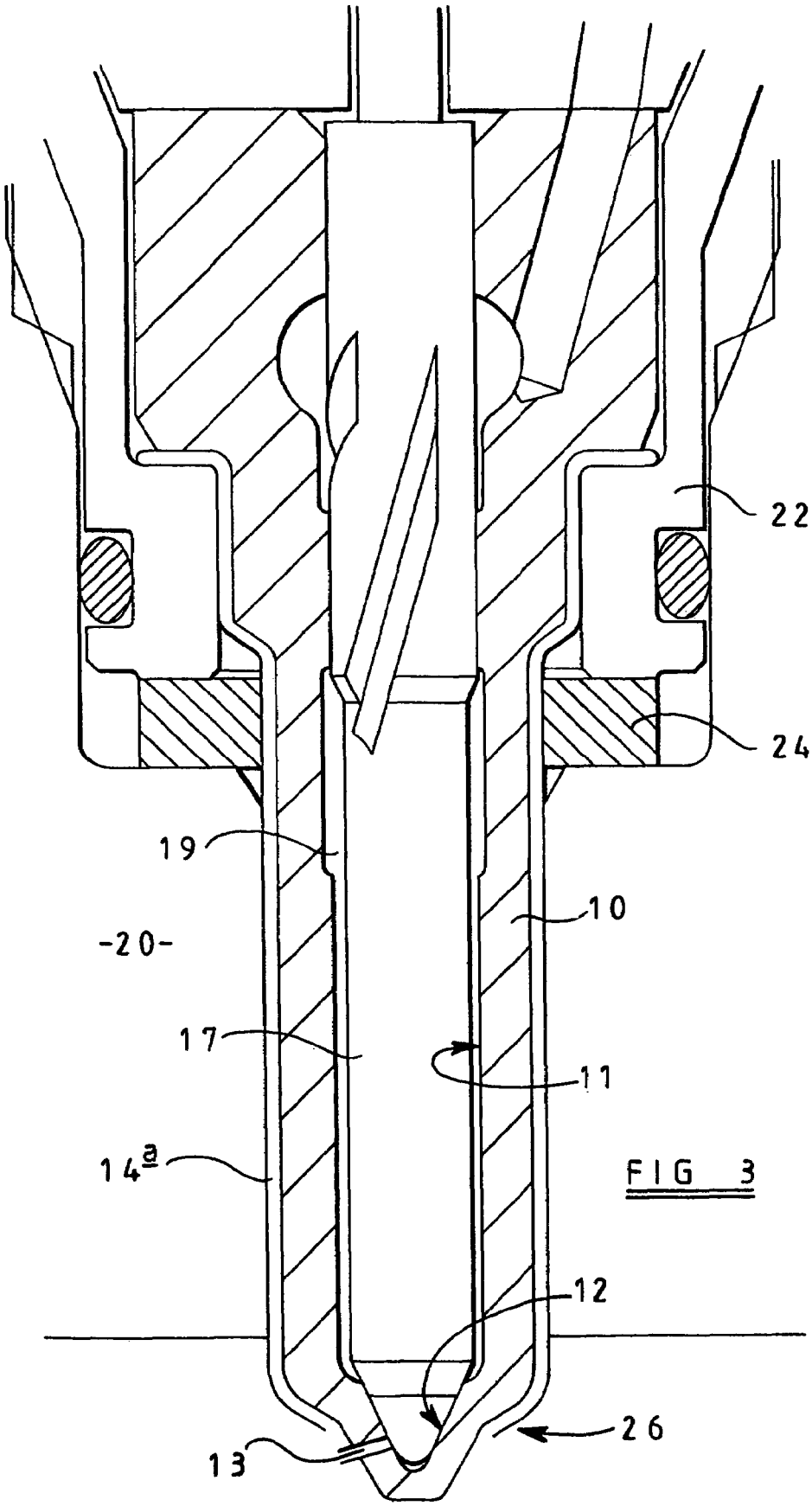

FIG. 3 is a further alternative embodiment of the invention, in which like reference numerals are used to denote similar parts to those shown in FIGS. 1 and 2. In this embodiment of the invention, the coating 14*a*, having a higher thermal conductivity than the thermal conductivity of the nozzle body 10, is only applied along a part of the exterior of the nozzle body 10, including the part of the exterior of the nozzle body 10 received within the cylinder head 20, such that at least a part of the tip region 26 remains uncoated. This further increases that rate of transfer of heat away from the region of the nozzle body 10 provided with the outlet openings 13 to the sealing member 24 and the cylinder head 20, thereby further reducing the operating temperature of this region of the nozzle body 10. It will be appreciated that more or less of the exterior of the nozzle body 10 may be coated, such that more or less of the tip region 26 to that shown in FIG. 3 remains uncoated.

Figure 4:
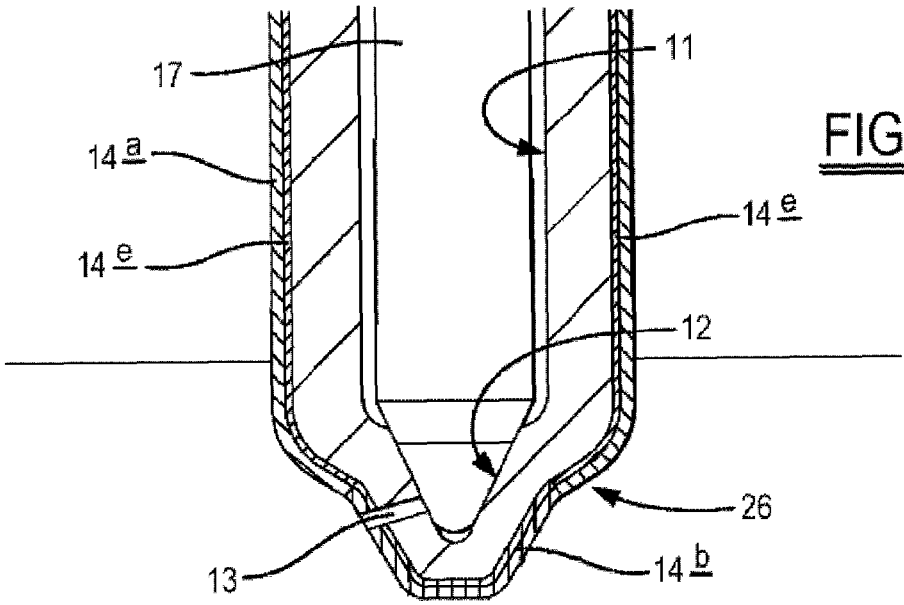
FIG. 4 is a diagrammatic sectional view of another embodiment of the present invention.

With reference to FIG. 4, in a still further preferred embodiment, the part of the tip region 26 which is uncoated in FIG. 3 may be coated with a material 14*b* having a lower thermal conductivity than the thermal conductivity of the nozzle body 10. For example, at least a part of the tip region 26 may be coated with a ceramic material. This provides the further advantage that the rate of heat transfer to the ceramic coated part of the tip region 26 is reduced, whilst the coating 14*a* of higher thermal conductivity increases the rate of heat transfer away from the tip region 26. Thus, the operating temperature of the part of the tip region 26 provided with the outlet openings 13 is further reduced.

In order to achieve the desired level of heat transfer away from the nozzle body 10, it may be desirable to provide a coating 14*a* having a thickness of up to 1 mm.

Figure 5:
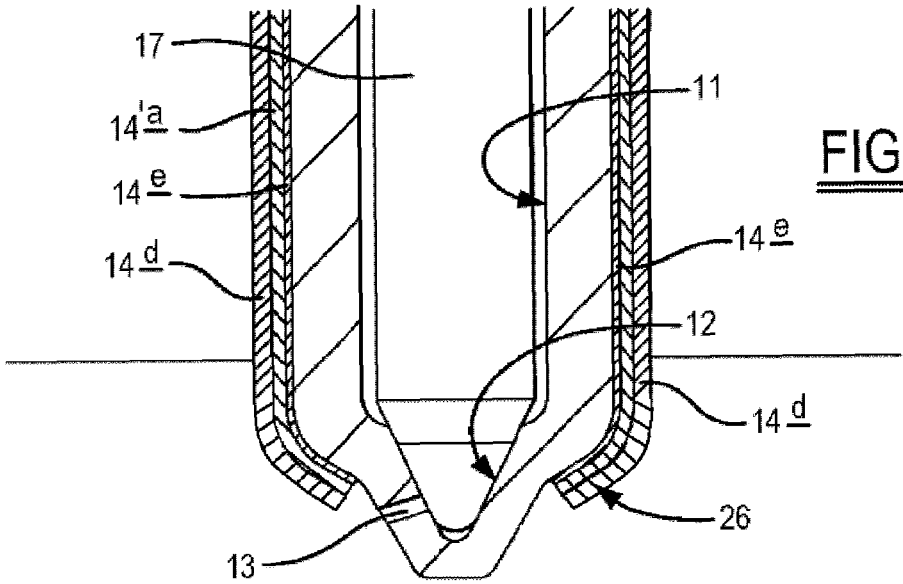
FIG. 5 is a diagrammatic sectional view of still another embodiment of the present invention; and, FIG. 6 is a diagrammatic sectional view of a further embodiment of the present invention.
Figure 6:
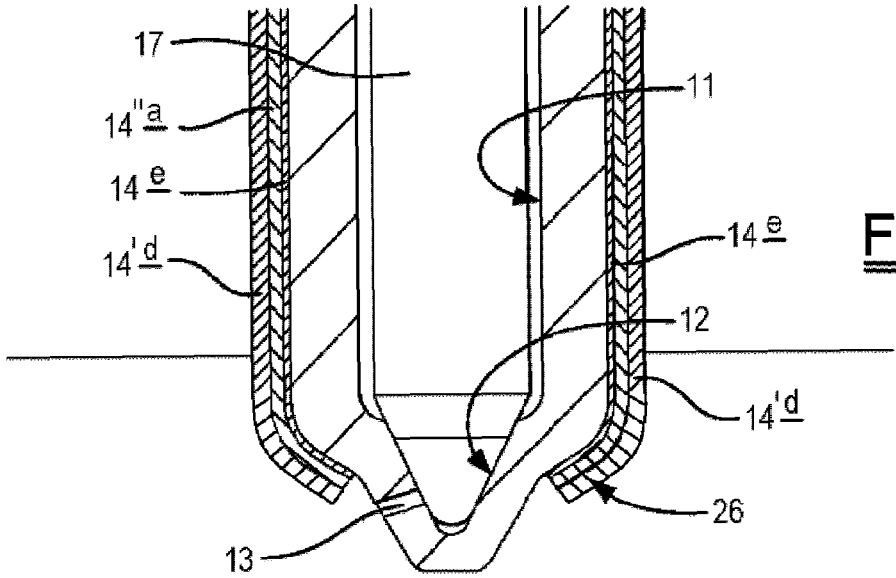

With reference to FIG. 5, in a further alternative embodiment to those shown in FIGS. 1 to 3, the nozzle body 10 may be provided with a multi-layer coating, whereby a first coating 14'*a* having a lower thermal conductivity than the thermal conductivity of the nozzle body 10 is applied to the nozzle body 10 (as shown in FIG. 1 or 3) and a further coating 14*d* having a higher thermal conductivity than the thermal conductivity of the nozzle body 10 is applied to the first coating 14'*a*. Typically, the further coating 14*d* may be formed from a material having properties similar to that of the coating 14*a*, as described previously with reference to FIGS. 2 and 3. As described previously, the first coating 14'*a* serves to insulate the nozzle body 10, whilst the further coating 14*d* will aid the conduction of heat away from the nozzle body 10. Alternatively, as shown in FIG. 6, the order in which the coatings are layered may be reversed such that a first coating 14"*a* having a relatively high thermal conductivity is applied to the nozzle body 10 and an additional coating 14'*d* having a relatively low thermal conductivity is applied to the first coating 14"*a*. Typically, the additional coating 14'*d* may be formed from a material having properties similar to the coating 14, as described previously with reference to FIG. 1. This alternative embodiment is particularly advantageous if the additional coating 14'*d* (i.e. the outermost layer) having a relatively low thermal conductivity is only applied to a lower region of the nozzle body 10, preferably only that region which projects from the cylinder head 20 and is exposed to temperatures within the combustion space.

In any of the embodiments of the invention, and for either a ceramic or other material, an additional substrate material 14*e* may be applied to the nozzle body 10 to which a coating 14, 14*a*, 14*b* is to be applied to ensure satisfactory bonding of the coating(s) to the nozzle body. Additionally, in any of the embodiments of the invention, the nozzle body 10 preferably forms an interference fit within the cylinder head 20, as this improves the effectiveness of the coating 14, 14*a*, 14'*a*. The effect of the coating(s) is also improved if the nozzle body 10 forms an interference fit within the cap nut 22.

As mentioned hereinbefore, the invention is not restricted to the particular type of injector described hereinbefore, or to injectors suitable for use with common rail type fuel systems. By way of example, the invention is also applicable to fuel pressure actuable injectors suitable for use with rotary distributor pumps, to injectors of the outwardly opening type and to injectors having more than one set of outlet openings and having a valve needle operable between first and second stages of lift.

What is claimed is:

1. An injection nozzle for use in delivering fuel to a combustion space, the injection nozzle comprising a nozzle body, the nozzle body including a substantially conical tip region extending along a longitudinal axis of the nozzle body, the tip region including an outlet opening, the outlet opening being oriented substantially transverse to the longitudinal axis, at least a part of the nozzle body being provided with a first coating and a second coating applied to at least part of said first coating to form a multi-layer coating, said multi-layer coating ananged so as to reduce the temperature of at least a part of the nozzle body, in use, said first coating being formed from a material having a higher thermal conductivity than the thermal conductivity of the nozzle body, said second coating being formed from a material having a lower thermal conductivity than the thermal conductivity of the nozzle body.

2. The injection nozzle as claimed in claim 1, wherein a part of the tip region of the nozzle body remains uncoated.

3. The injection nozzle as claimed in claim 1, wherein said second coating is a ceramic material.

4. The injection nozzle as claimed in claim 1, wherein said second coating is only applied to a part of said first coating.

5. The injection nozzle as claimed in claim 1, comprising an additional substrate material applied to the nozzle body, whereby said first coating is bonded to the nozzle body by means of the additional substrate material.

6. The injection nozzle as claimed in claim 1, wherein said multi-layer coating is provided over at least the part of the exterior of the nozzle body.

7. The injection nozzle as claimed in claim 6, wherein the nozzle body is provided with more than one outlet opening, each outlet opening being provided in the tip region of the nozzle body.

* * * * *